US011715434B2

(12) United States Patent
Ji

(10) Patent No.: US 11,715,434 B2
(45) Date of Patent: Aug. 1, 2023

(54) DISPLAY PANEL, DRIVING METHOD FOR DISPLAY PANEL, AND DISPLAY APPARATUS

(71) Applicant: HKC CORPORATION LIMITED, Shenzhen (CN)

(72) Inventor: Feilin Ji, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/042,172

(22) PCT Filed: Dec. 27, 2018

(86) PCT No.: PCT/CN2018/124179
§ 371 (c)(1),
(2) Date: Sep. 27, 2020

(87) PCT Pub. No.: WO2020/098095
PCT Pub. Date: May 22, 2020

(65) Prior Publication Data

US 2021/0082359 A1 Mar. 18, 2021

(30) Foreign Application Priority Data

Nov. 12, 2018 (CN) ..... 201811337204.9

(51) Int. Cl.
*G09G 3/36* (2006.01)

(52) U.S. Cl.
CPC ..... *G09G 3/3607* (2013.01); *G09G 3/3614* (2013.01); *G09G 2300/0452* (2013.01); *G09G 2320/0247* (2013.01)

(58) Field of Classification Search
CPC .. G09G 3/3607; G09G 3/3614; G09G 3/2003; G09G 3/20; G09G 3/3208;
(Continued)

(56) References Cited

U.S. PATENT DOCUMENTS

2006/0114207 A1* 6/2006 Lee ..... G09G 3/3648 345/89
2010/0328360 A1* 12/2010 Miyashita ..... G09G 3/3614 345/209
(Continued)

FOREIGN PATENT DOCUMENTS

CN 101937142 A 1/2011
CN 103903543 A 7/2014
(Continued)

OTHER PUBLICATIONS

Jingyi Tian, the ISA written comments, dated Aug. 2019, CN.
Jingyi Tian, the International Search Report, dated Aug. 2019, CN.

*Primary Examiner* — David Tung

(57) ABSTRACT

This application discloses a display panel, a driving method for a display panel, and a display apparatus. The display panel includes a plurality of pixel groups. Each of the pixel groups includes a first pixel element and a second pixel element that are arranged in a first direction; the first pixel element and the second pixel element respectively include the same quantity of pixels of different colors arranged along a second direction; and the first direction is perpendicular to the second direction. In a same frame, a polarity of a driving signal corresponding to a pixel of a color in the first pixel element is opposite to a polarity of a driving signal corresponding a pixel of the color in the second pixel element.

7 Claims, 7 Drawing Sheets

(58) Field of Classification Search
CPC ... G09G 2300/0452; G09G 2310/0254; G09G 2320/0247; G09G 2320/0242
See application file for complete search history.

(56) References Cited

U.S. PATENT DOCUMENTS

| | | | | |
|---|---|---|---|---|
| 2011/0242065 | A1* | 10/2011 | Hsu | G09G 3/006 345/204 |
| 2016/0155401 | A1* | 6/2016 | Lee | G09G 3/3607 345/694 |
| 2017/0221436 | A1* | 8/2017 | Guo | G09G 3/3607 |
| 2017/0330520 | A1* | 11/2017 | Tien | G09G 3/3614 |
| 2018/0204531 | A1* | 7/2018 | Su | G09G 3/3607 |

FOREIGN PATENT DOCUMENTS

| | | | |
|---|---|---|---|
| CN | 104049396 | A | 9/2014 |
| CN | 2015118113 | A | 6/2015 |
| CN | 105511187 | A | 4/2016 |
| CN | 106652951 | A | 5/2017 |
| EP | 0415349 | A2 | 3/1991 |
| KR | 20100137843 | A | 12/2010 |

* cited by examiner

DISPLAY PANEL, DRIVING METHOD FOR DISPLAY PANEL, AND DISPLAY APPARATUS

CROSS REFERENCE OF RELATED APPLICATIONS

This application claims the priority to the Chinese Patent Application No. CN201811337204.9, filed with National Intellectual Property Administration, PRC on Nov. 12, 2018 and entitled "DISPLAY PANEL, DRIVING METHOD FOR DISPLAY PANEL, AND DISPLAY APPARATUS", which is incorporated herein by reference in its entirety.

TECHNICAL FIELD

This application relates to the display field, and in particular, to a display panel, a driving method for a display panel, and a display apparatus.

BACKGROUND

Statement herein merely provides background information related to this application and does not necessarily constitute the existing technology.

With the advancement of science and technology, due to various advantages such as thinness, power saving, and low radiation, flat panel displays become mainstream products of displays and are widely applied. A flat panel display includes a Thin Film Transistor-Liquid Crystal Display (TFT-LCD), an Organic Light-Emitting Diode (OLED) display, and the like. The TFT-LCD controls rotating directions of liquid crystal molecules, to enable light in a backlight source to be refracted out to generate a picture, and the TFT-LCD has various advantages such as thin body, power saving, and no radiation. The OLED display is manufactured by using an organic electroluminescent diode, and has various advantages such as self-luminescent, short response time, high resolution and contrast, soft screen display, and large area full color display.

As people are increasingly aware of energy saving and emission reduction, the advantages of energy saving of RGBW(R, Red pixel; G, Green pixel; B, Blue pixel; W, White pixel) technology are becoming more and more prominent in the development of liquid crystal panel, so market demands for panels applied RGBW technology is increasing. RGBW technology may not only bring consumers high brightness and high contrast in white screen, but also may reduce the brightness of backlight, so as to reduce energy consuming of liquid crystal panel and achieve the objective of energy saving. For a common arrangement of RGBW, if a previous conventional driving method is used, polarities of pixels of the same color in a same picture are all the same and flickering occurs.

SUMMARY

This application provides a display panel, a driving method for a display panel, and a display apparatus, to avoid screen flickering.

To achieve the foregoing objective, this application provides a display panel, including: a plurality of pixel groups, where each of pixel groups includes a first pixel element and a second pixel element that are arranged in a first direction. The first pixel element and the second pixel element respectively include the same quantity of pixels of different colors arranged along a second direction. In a same frame, a polarity of a driving signal corresponding to a pixel of a color in the first pixel element is opposite to a polarity of a driving signal corresponding a pixel of the color in the second pixel element.

Optionally, the first direction is a column direction and the second direction is a row direction. The first pixel element includes eight pixels adjacent to each other and arranged in a row, and the pixels are arranged in the following order: a first pixel, a second pixel, a third pixel and a fourth pixel, which are arranged horizontally in sequence and repeated according to the order. The second pixel element includes eight pixels adjacent to each other and arranged in a row, and the pixels are arranged in the following order: a third pixel, a fourth pixel, a first pixel and a second pixel, which are arranged horizontally in sequence and repeated according to the order.

Optionally, the first direction is a row direction and the second direction is a column direction. The first pixel element includes eight pixels adjacent to each other and arranged in a column, and the pixels are arranged in the following order: a first pixel, a second pixel, a third pixel and a fourth pixel, which are arranged vertically in sequence and repeated according to the order. The second pixel element includes eight pixels adjacent to each other and arranged in a column, and the pixels are arranged in the following order: a third pixel, a fourth pixel, a first pixel and a second pixel, which are arranged vertically in sequence and repeated according to the order.

Optionally, the first pixel is red, the second pixel is green, the third pixel is blue and the fourth pixel is white.

This application further discloses a driving method for the display panel described above, and the driving method includes the following steps:

outputting, during a polar period, a driving signal to a corresponding pixel; and outputting, during a next polar period, a driving signal of a reversed polarity to a corresponding pixel.

In the step of outputting, during a polar period, a driving signal to a corresponding pixel, a polarity of a driving signal output for a pixel of a color in the first pixel element is opposite to a polarity of a driving signal output for a pixel of the color in the second pixel element.

Optionally, the first pixel element includes eight pixels adjacent to each other and arranged in a row, and the pixels are arranged in the following order: a first pixel, a second pixel, a third pixel and a fourth pixel, which are arranged horizontally in sequence and repeated according to the order. The second pixel element includes eight pixels adjacent to each other and arranged in a row, and the pixels are arranged in the following order: a third pixel, a fourth pixel, a first pixel and a second pixel, which are arranged horizontally in sequence and repeated according to the order. The first direction is a column direction and the second direction is a row direction.

In the step of outputting, during a polar period, a driving signal to a corresponding pixel to drive the display panel:

in the first pixel element, polarities of driving signals applied to the first four pixels are arranged as follows: the polarities of the driving signals applied to the first pixel and the fourth pixel, are the same, the polarities of the driving signals applied to the second pixel and the third pixel are the same, and the polarities of the driving signals applied to the first pixel and the fourth pixel are opposite to the polarities of the driving signals applied to the second pixel and the third pixel; polarities of driving signals applied to the last four pixels in the first pixel element are respectively opposite to the polarities of the driving signals applied to the same pixels among the first four pixels;

in the second pixel element, polarities of driving signals applied to the first four pixels are arranged as follows: the polarities of the driving signals applied to the third pixel and the second pixel are the same, the polarities of the driving signals applied to the fourth pixel and the first pixel are the same, and the polarities of the driving signals applied to the third pixel and the second pixel are opposite to the polarities of the driving signals applied to the fourth pixel and the first pixel; polarities of driving signals applied to the last four pixels in the second pixel element are respectively opposite to the polarities of the driving signals applied to the same pixels among the first four pixels;

the polarities of the driving signals applied to the eight pixels in the first pixel element are opposite to the polarities of the driving signals applied to the vertically corresponding eight pixels in the second pixel element.

Optionally, in the first pixel element, the driving signals applied to the first four pixels are as follows: the polarity of the driving signal applied to the first pixel is positive, the polarity of the driving signal applied to the second pixel is negative, the polarity of the driving signal applied to the third pixel is negative and the polarity of the driving signal applied to the fourth pixel is positive; the polarities of the driving signals applied to the last four pixels in the first pixel element are respectively opposite to the polarities of the driving signals applied to the same pixels among the first four pixels;

in the second pixel element, the driving signals applied to the first four pixels are as follows: the polarity of the driving signal applied to the third pixel is negative, the polarity of the driving signal applied to the fourth pixel is positive, the polarity of the driving signal applied to the first pixel is positive and the polarity of the driving signal applied to the second pixel is negative; and the polarities of the driving signals applied to the last four pixels in the second pixel element are respectively opposite to the polarities of the driving signals applied to the same pixels among the first four pixels.

Optionally, in the first pixel element, the driving signals applied to the first four pixels are as follows: the polarity of the driving signal applied to the first pixel is negative, the polarity of the driving signal applied to the second pixel is positive, the polarity of the driving signal applied to the third pixel is positive and the polarity of the driving signal applied to the fourth pixel is negative; the polarities of the driving signals applied to the last four pixels in the first pixel element are respectively opposite to the polarities of the driving signals applied to the same pixels among the first four pixels;

in the second pixel element, the driving signals applied to the first four pixels are as follows: the polarity of the driving signal applied to the third pixel is positive, the polarity of the driving signal applied to the fourth pixel is negative, the polarity of the driving signal applied to the first pixel is negative and the polarity of the driving signal applied to the second pixel is positive; and the polarities of the driving signals applied to the last four pixels in the second pixel element are respectively opposite to the polarities of the driving signals applied to the same pixels among the first four pixels.

Optionally, the first pixel element includes eight pixels adjacent to each other and arranged in a column, and the pixels are arranged in the following order: a first pixel, a second pixel, a third pixel and a fourth pixel, which are arranged vertically in sequence and repeated according to the order. The second pixel element includes eight pixels adjacent to each other and arranged in a column, and the pixels are arranged in the following order: a third pixel, a fourth pixel, a first pixel and a second pixel, which are arranged vertically in sequence and repeated according to the order. The first direction is a column direction and the second direction is a row direction.

In the step of outputting, during a polar period, a driving signal to a corresponding pixel to drive the display panel:

in the first pixel element, polarities of driving signals applied to the first four pixels are arranged as follows: the polarities of the driving signals applied to the first pixel and the fourth pixel are the same, the polarities of the driving, signals applied to the second pixel and the third pixel are the same, and the polarities of the driving signals applied to the first pixel and the fourth pixel are opposite to the polarities of the driving signals applied to the second pixel and the third pixel; polarities of driving signals applied to the last four pixels in the first pixel element are respectively opposite to the polarities of the driving signals applied to the same pixels among the first four pixels;

in the second pixel element, polarities of driving signals applied to the first four pixels are arranged as follows: the polarities of the driving signals applied to the third pixel and the second pixel are the same, the polarities of the driving signals applied to the fourth pixel and the first pixel are the same, and the polarities of the driving signals applied to the third pixel and the second pixel are opposite to the polarities of the driving signals applied to the fourth pixel and the first pixel; polarities of driving signals applied to the last four pixels in the second pixel element are respectively opposite to the polarities of the driving signals applied to the same pixels among the first four pixels; and the polarities of the driving signals applied to the eight pixels in the first pixel element are opposite to the polarities of the driving signals applied to the vertically corresponding eight pixels in the second pixel element.

Optionally, the first pixel element includes eight pixels adjacent to each other and arranged in a column, and the pixels are arranged in the following order: a first pixel, a second pixel, a third pixel and a fourth pixel, which are arranged vertically in sequence and repeated according to the order. The second pixel element includes eight pixels adjacent to each other and arranged in a column, and the pixels are arranged in the following order: a third pixel, a fourth pixel, a first pixel and a second pixel, which are arranged vertically in sequence and repeated according to the order. The first direction is a row direction and the second direction is a column direction.

In the step of outputting, during a polar period, a driving signal to a corresponding pixel to drive the display panel:

in a row of pixel groups having eight rows of pixels, polarities of driving signals applied to the first four pixels of each odd-numbered row are arranged as follows: the polarity of the driving signal applied to the first pixel is opposite to the polarity of the driving signal applied to the third pixel, the polarities of the driving signals applied to the former first pixel and the former third pixel are respectively opposite to the polarities of the driving signals applied to the latter first pixel and the latter third pixel; and polarities of driving signals applied to the last four pixels of the odd-numbered row are opposite to the polarities of the driving signals applied to the same pixels among the first four pixels; the polarities of the driving signals applied to each row of pixels are arranged with every eight pixels as one period.

in a row of pixel groups having eight rows of pixels, polarities of driving signals applied to the first four pixels of each even-numbered row are arranged as follows: the polarity of the driving signal applied to the second pixel is opposite to the polarity of the driving signal applied to the fourth pixel, the polarities of the driving signals applied to the former second pixel and the former fourth pixel are respectively opposite to the polarities of the driving signals applied to the latter second pixel and the latter fourth pixel; and polarities of driving signals applied to the last four pixels of the even-numbered row are opposite to the polarities of the driving signals applied to the same pixels among the first four pixels; the polarities of the driving signals applied to each row of pixels are arranged with every eight pixels as one period; and in a row of pixel groups, the polarities of the driving signals applied to the eight pixels in the odd-numbered row are opposite to the polarities of the driving signals applied to the vertically corresponding eight pixels in the even-numbered row.

Optionally, the polar period is a display time of one frame.

Optionally, the polar period is a display time of two frames.

This application further discloses a display apparatus driven by a driving method for a display panel. The display apparatus includes a display panel and a driving apparatus. The display panel includes a plurality of pixel groups. Each of the pixel groups includes a first pixel element and a second pixel element that are arranged in columns. The first pixel element and the second pixel element respectively include the same quantity of pixels of different colors. The driving apparatus is configured to output a driving signal to drive the display panel. A polarity of a driving signal output by the driving apparatus to a pixel of a color in the first pixel element of the display panel is opposite to a polarity of a driving signal output by the driving apparatus to a pixel of the color in the second pixel element.

Optionally, the display apparatus includes: the first pixel element includes eight pixels adjacent to each other and arranged in a row, and the pixels are arranged in the following order: a first pixel, a second pixel, a third pixel and a fourth pixel, which are arranged horizontally in sequence and repeated according to the order. The second pixel element includes eight pixels adjacent to each other and arranged in a row, and the pixels are arranged in the following order: a third pixel, a fourth pixel, a first pixel and a second pixel, which are arranged horizontally in sequence and repeated according to the order.

Optionally, the display apparatus includes: the first pixel element includes eight pixels adjacent to each other and arranged in a column, and the pixels are arranged in the following order: a first pixel, a second pixel, a third pixel and a fourth pixel, which are arranged vertically in sequence and repeated according to the order. The second pixel element includes eight pixels adjacent to each other and arranged in a column, and the pixels are arranged in the following order: a third pixel, a fourth pixel, a first pixel and a second pixel, which are arranged vertically in sequence and repeated according to the order.

Optionally, the display panel is a Vertical Alignment panel.

Compared with a solution using a conventional polarity driving method, in this application, a plurality of pixel groups. Each of the pixel groups includes a first pixel element and a second pixel element that are arranged in columns. In the first pixel element and the second pixel element, when pixels of the same color are driven, polarities of driving voltages are opposite. In this way, in a displayed picture, driving signals of pixels of the same color do not have the same polarity, so as to avoid flickering due to uneven display caused by voltage interference and deviation when driving signals of pixels of the same color have the same polarity, ensure even display of colors in the same pixel group, and avoid screen flickering during displaying.

BRIEF DESCRIPTION OF DRAWINGS

The included accompanying drawings are used to provide further understanding of the embodiments of this application, constitute a part of the specification, and are used to illustrate implementations of this application and explain the principle of this application together with literal descriptions. Apparently, the accompanying drawings in the following descriptions are merely some embodiments of this application, and a person of ordinary skill in the art can also obtain other accompanying drawings according to these accompanying drawings without involving any creative effort. In the accompanying drawings.

DETAILED DESCRIPTION OF EMBODIMENTS

Figure 1:
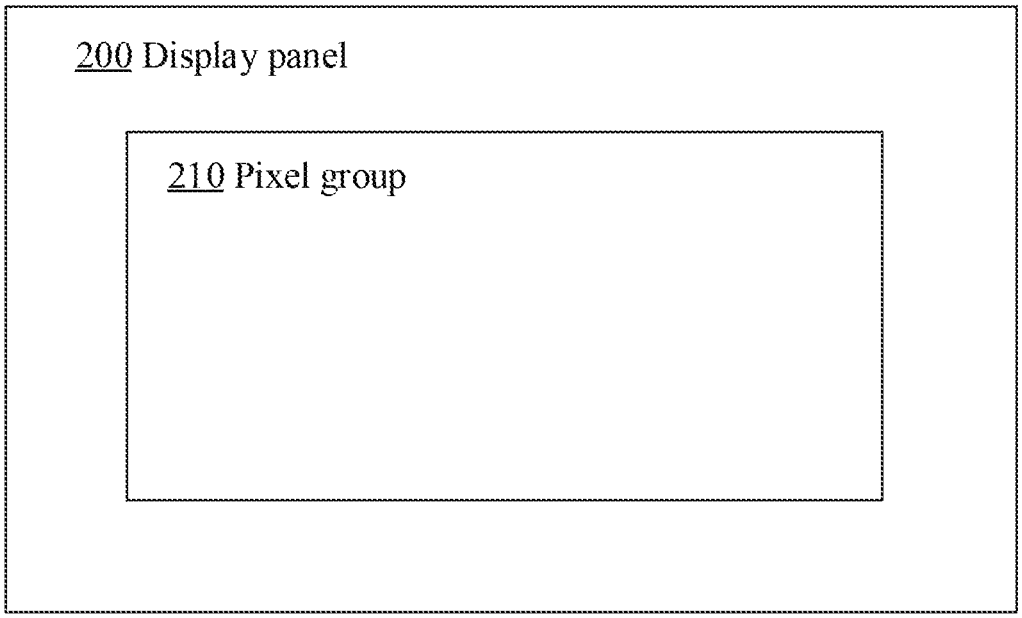
FIG. 1 is a schematic diagram of a display panel according to an embodiment of this application.

Specific structures and functional details disclosed herein are merely representative, and are intended to describe the objectives of the exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Therefore, a feature defined by "first" or "second" can explicitly or implicitly includes one or more of said features. In the description of this application, unless otherwise stated, "a plurality of" means two or more than two. In addition, the terms "include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, operations, units, and/or components, but do not preclude the presence or addition of one or more other features, integers, steps, operations, units, components, and/or combinations thereof.

This application is further described below with reference to the accompanying drawings and embodiments.

Figure 3:
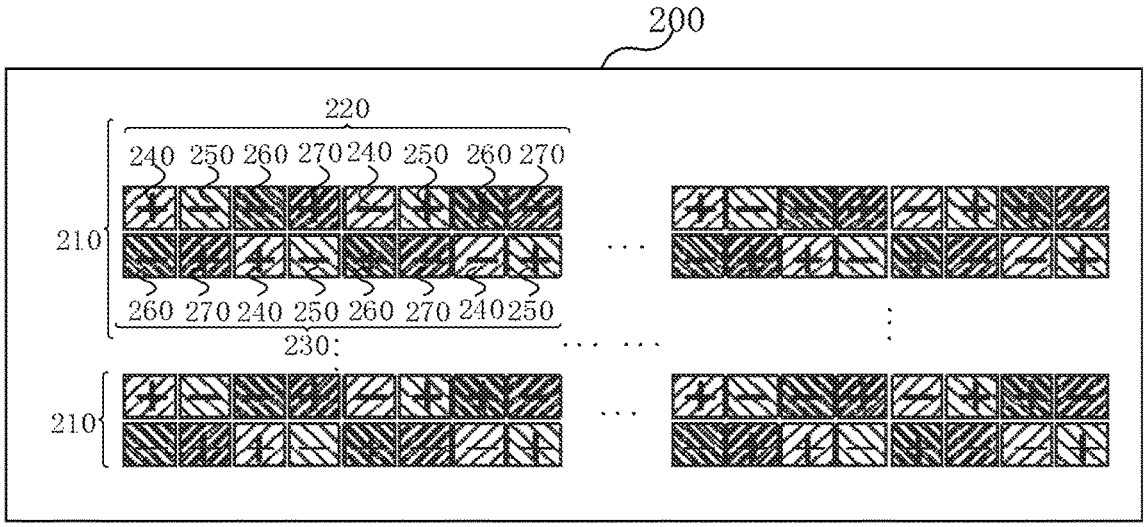
FIG. 3 is a schematic diagram of a polarity driving method in odd-numbered frames for a display panel according to an embodiment of this application.

FIG. 1 is a schematic diagram of a display panel. Referring to FIG. 1 and FIG. 3, a display panel 200 includes a plurality of pixel groups 210. Each of the pixel groups 210 includes a first pixel element 220 and a second pixel element 230 that are arranged in a first direction. The first pixel element 220 and the second pixel element 230 respectively include the same quantity of pixels of different colors arranged along a second direction. The first direction is perpendicular to the second direction. In a same frame, a polarity of a driving signal corresponding to a pixel of a color in the first pixel element 220 is opposite to a polarity of a driving signal corresponding a pixel of the color in the second pixel element 230.

Figure 2:
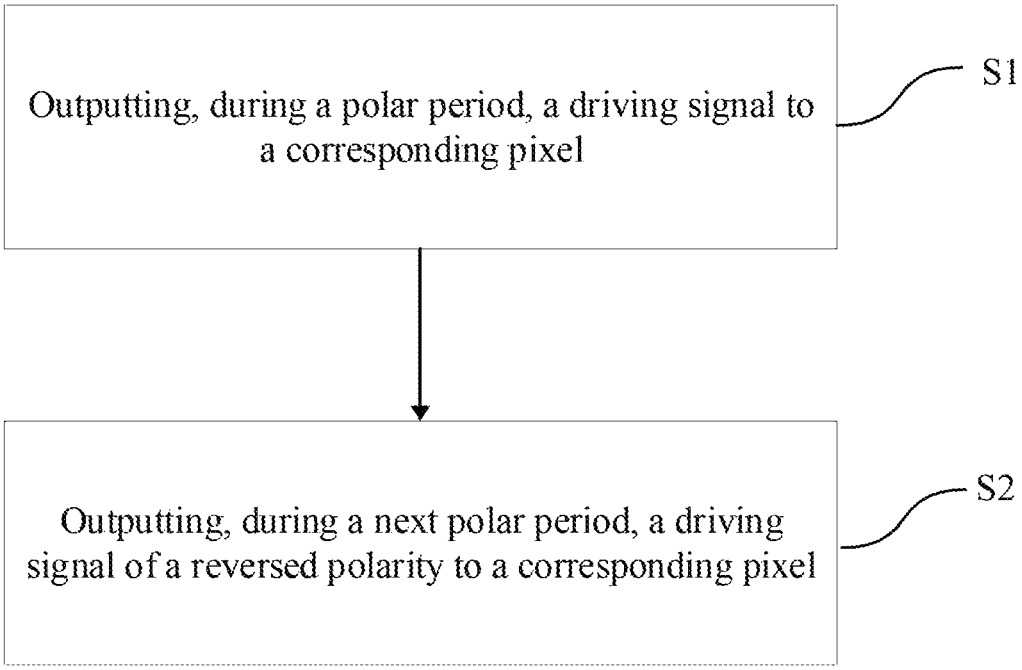
FIG. 2 is a flowchart of a driving method for a display panel according to an embodiment of this application.

FIG. 2 is a flowchart of a driving method for a display panel. Referring to FIG. 2, the driving method includes the following steps:

S1: outputting, during a polar period, a driving signal to a corresponding pixel; and S2: outputting, during a next polar period, a driving signal of a reversed polarity to a corresponding pixel.

In the step of outputting, during a polar period, a driving signal to a corresponding pixel, a polarity of a driving signal output for a pixel of a color in the first pixel element is opposite to a polarity of a driving signal output for a pixel of the color in the second pixel element.

In the display panel, a plurality of pixel groups 210 each include a first pixel element 220 and a second pixel element 230 that are arranged in columns. In the first pixel element 220 and the second pixel element 230, when pixels of the same color are driven, polarities of driving voltages are opposite. In this way, in a displayed picture, driving signals of pixels of the same color do not have the same polarity, so as to avoid flickering due to uneven display caused by voltage interference and deviation when driving signals of pixels of the same color have the same polarity, ensure even display of colors in the same pixel group 210, and avoid screen flickering during displaying. Signal reversal means that a polarity of a driving signal applied to a pixel in a polar period is positive, and a polarity of a driving signal applied to the pixel in a next polar period is negative. Such reversal also applies to other pixels.

Figure 4:
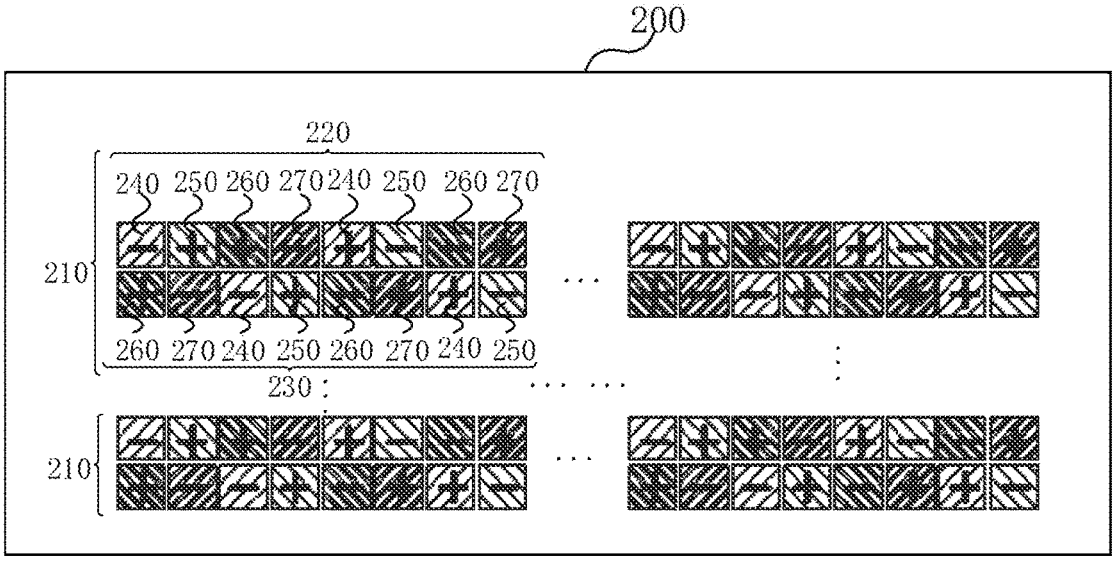
FIG. 4 is a schematic diagram of a polarity driving method in even-numbered frames for a display panel according to an embodiment of this application.

For pixel arrangements shown in FIG. 3 and FIG. 4, the first direction is a column direction and the second direction is a row direction. The first pixel element 220 includes eight pixels adjacent to each other and arranged in a row, and the pixels are arranged in the following order: a first pixel 240, a second pixel 250, a third pixel 260 and a fourth pixel 270, which are arranged horizontally in sequence and repeated according to the order. The second pixel element 230 includes eight pixels adjacent to each other and arranged in a row, and the pixels are arranged in the following order: a third pixel 260, a fourth pixel 270, a first pixel 240 and a second pixel 250, which are arranged horizontally in sequence and repeated according to the order. This solution provides a pixel architecture having eight pixels. The eight pixels in the first pixel element 220 are arranged in a row, including two first pixels 240, two second pixels 250, two third pixels 260 and two fourth pixels 270. Two identical pixels are spaced by three other pixels, and the three other pixels are of different colors, to achieve even display of colors in a pixel. In the first pixel element 220 and the second pixel element 230, only the order in which the pixels are arranged is changed, so that any two neighboring pixels selected from the first pixel element 220 and two neighboring pixels in the second pixel element 230 can constitute four different pixels. Such a configuration achieves a more even pixel arrangement of the entire display panel 200. The colors of the same pixels are the same.

Based on the above pixel arrangement, the method for driving a display panel by applying a driving signal is as follows:

In step S1, in the first pixel element 220, polarities of driving signals applied to the first four pixels are arranged as follows: the polarities of the driving signals applied to the first pixel 240 and the fourth pixel 270 are the same, the polarities of the driving signals applied to the second pixel 250 and the third pixel 260 are the same, and the polarities of the driving signals applied to the first pixel 240 and the fourth pixel 270 are opposite to the polarities of the driving signals applied to the second pixel 250 and the third pixel 260; and the polarities of the driving signals applied to the last four pixels in the first pixel element are opposite to the polarities of the same pixels among the first four pixels. In a specific implementation, the polarity of the driving signal applied to the first pixel 240 is positive, the polarity of the driving signal applied to the second pixel 250 is negative, the polarity of the driving signal applied to the third pixel 260 is negative and the polarity of the driving signal applied to the fourth pixel 270 is positive. The polarities of the driving signals applied to the last four pixels are as follows: the polarity of the driving signal applied to the first pixel 240 is negative, the polarity of the driving signal applied to the second pixel 250 is positive, the polarity of the driving signal applied to the third pixel 260 is positive and the polarity of the driving signal applied to the fourth pixel 270 is negative A symbol representation is +−−+−++−.

In the second pixel element 230, polarities of driving signals applied to the first four pixels are arranged as follows: the polarities of the driving signals applied to the third pixel 260 and the second pixel 250 are the same, the polarities of the driving signals applied to the fourth pixel 270 and the first pixel 240 are the same, and the polarities of the driving signals applied to the third pixel 260 and the second pixel 250 are opposite to the polarities of the driving signals applied to the fourth pixel 270 and the first pixel 240, and the polarities of the driving signals applied to the last four pixels in the second pixel element are opposite to the polarities of the same pixels among the first four pixels. In a specific implementation, the polarity of the driving signal applied to the third pixel 260 is negative, the polarity of the driving signal applied to the fourth pixel 270 is positive, the polarity of the driving signal applied to the first pixel 240 is positive and the polarity of the driving signal applied to the second pixel 250 is negative. The polarities of the driving signals applied to the last four pixels are as follows: the polarity of the driving signal applied to the third pixel 260 is positive, the polarity of the driving signal applied to the fourth pixel 270 is negative, the polarity of the driving signal applied to the first pixel 240 is negative and the polarity of the driving signal applied to the second pixel 250 is positive. A symbol representation is −++−+−−+.

In a next polar period, polarities of driving signals at corresponding positions of the original pixels are reversed. In other words, in the first pixel element 220, the polarities of the driving signals applied to the first four pixels are as follows: the polarity of the driving signal applied to the first pixel 240 is negative, the polarity of the driving signal applied to the second pixel 250 is positive, the polarity of the driving signal applied to the third pixel 260 is positive and the polarity of the driving signal applied to the fourth pixel 270 is negative. In the second pixel element 230, the polarities of the driving signals applied to the last four pixels are as follows: the polarity of the driving signal applied to the third pixel 260 is positive, the polarity of the driving signal applied to the fourth pixel 270 is negative, the polarity of the driving signal applied to the first pixel 240 is negative and the polarity of the driving signal applied to the second pixel 250 is positive. A symbol representation is −++−+−−+. In the second pixel element 230, the polarities of the driving signals applied to the first four pixels are as follows: the polarity of the driving signal applied to the third pixel 260 is positive, the polarity of the driving signal applied to the fourth pixel 270 is negative, the polarity of the driving signal applied to the first pixel 240 is negative and the polarity of the driving signal applied to the second pixel 250 is positive. The polarities of the driving signals applied to the last four pixels are as follows: the polarity of the driving signal applied to the third pixel 260 is negative, the polarity of the driving signal applied to the fourth pixel 270 is positive, the polarity of the driving signal applied to the first pixel 240 is positive and the polarity of the driving signal applied to the second pixel 250 is negative. A symbol representation is +−−+−++−.

This solution is a polarity driving method for the above pixel architecture. The polarities of the driving signals applied to the eight pixels in the first pixel element 220, namely, the first pixel 240, the second pixel 250, the third pixel 260, the fourth pixel 270, the first pixel 240, the second pixel 250, the third pixel 260 and the fourth pixel 270, are respectively represented as +−−+−++−. In this case, the polarities of the driving signals applied to the two first pixels 240 in the first pixel element 220 are different. Similarly, the polarities of the driving signals applied to the two second pixels 250 are different, the polarities of the driving signals applied to the two third pixels 260 are different, and the polarities of the driving signals applied to the two fourth pixels 270 are different. In both the second pixel element 230 and the first pixel element 220, driving signals of opposite polarities are applied to same pixels. In a next polar period, polarities of pixels at the same positions are opposite to those in the previous period. In this, case, in the first pixel element 220 and the second pixel element 230, the quantity of pixels of negative polarity is equal to the quantity of pixels of positive polarity. Therefore, the quantity of pixels of negative polarity is also equal to the quantity of pixels of positive polarity in a picture of the entire display panel 200, so as to effectively avoid screen flickering.

Figure 5:
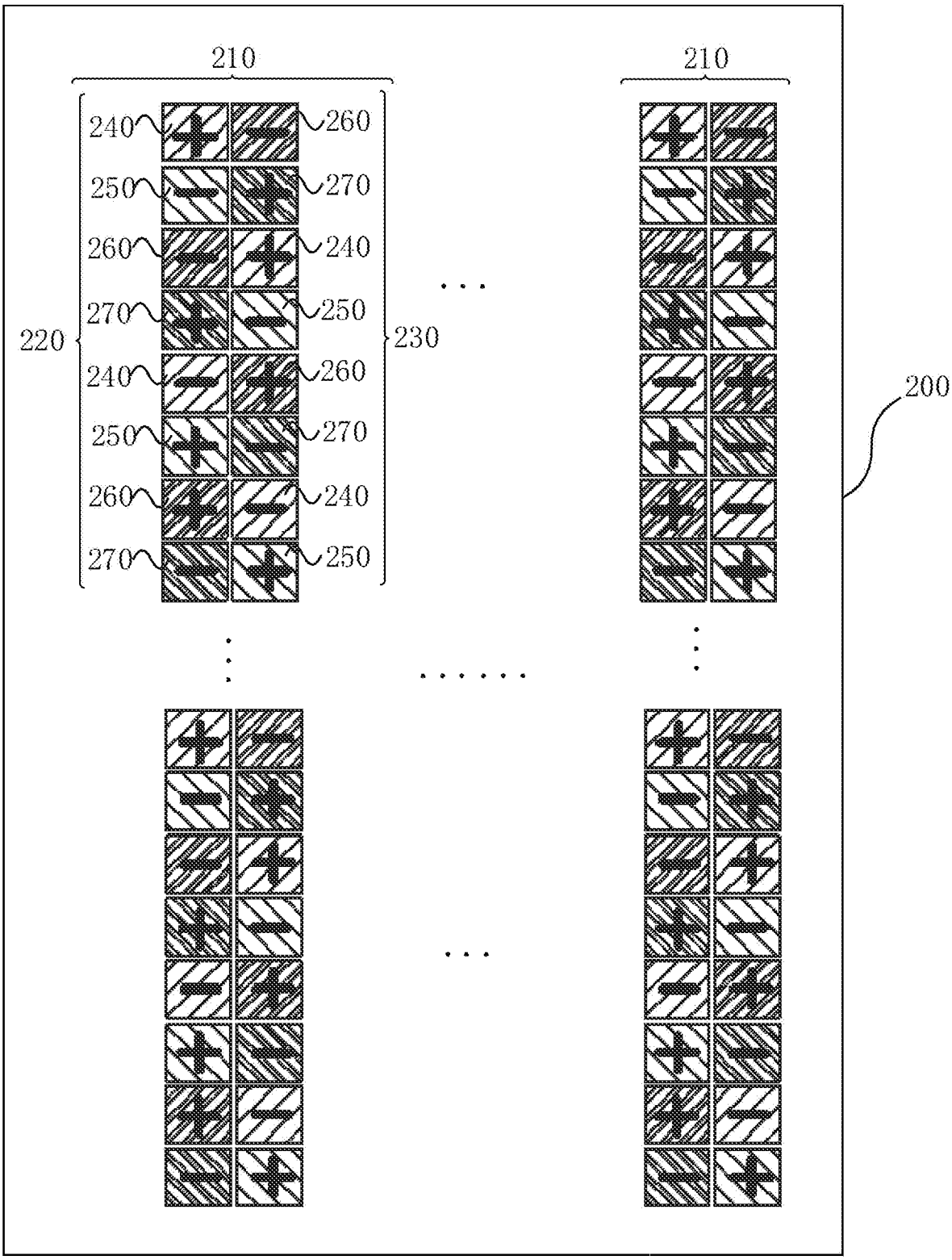
FIG. 5 is a schematic diagram of another polarity driving method in odd-numbered frames for a display panel according to an embodiment of this application.
Figure 6:
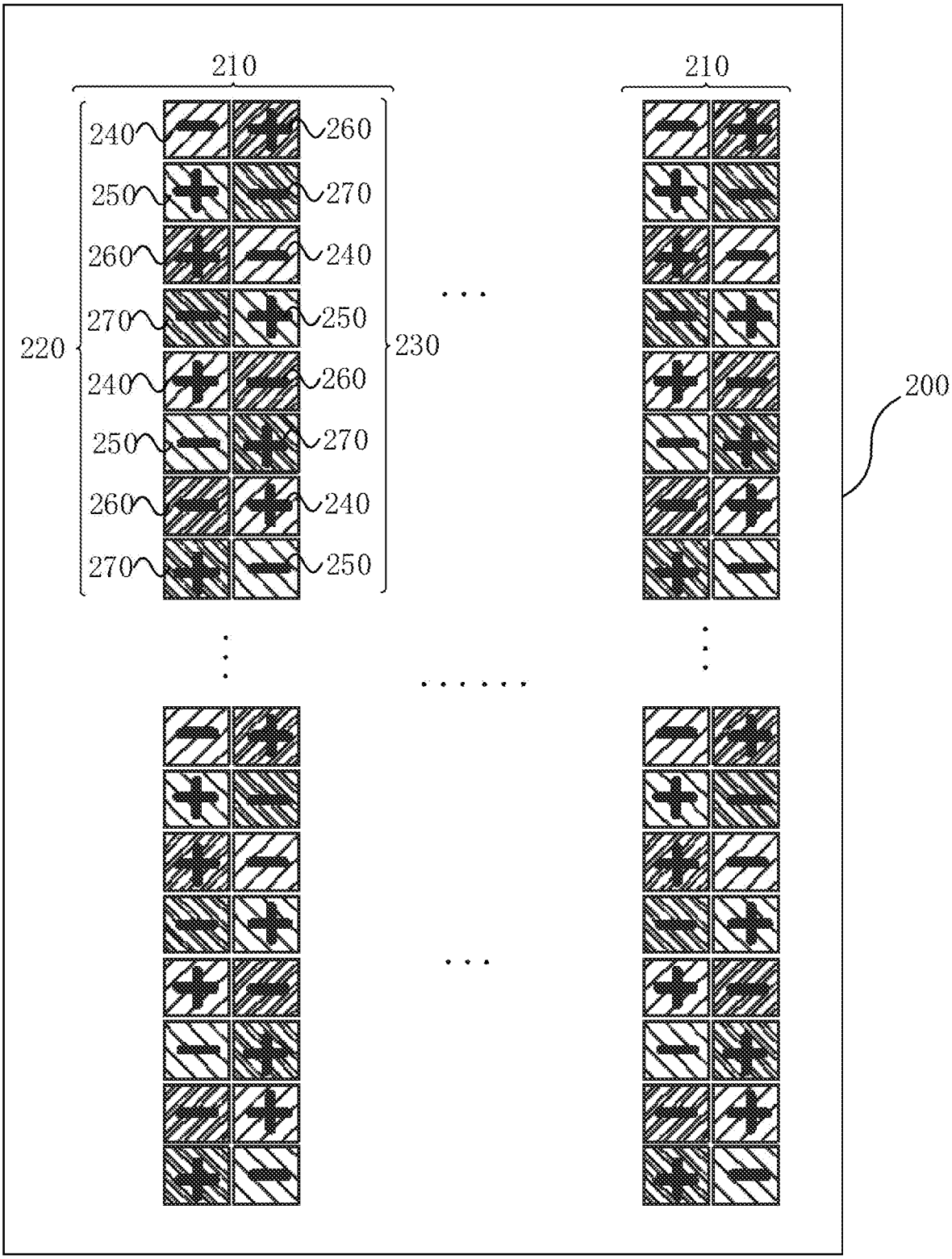
FIG. 6 is a schematic diagram of another polarity driving method in even-numbered frames for a display panel according to an embodiment of this application.

Certainly, as can be seen from pixel arrangements shown in FIG. 5 and FIG. 6 and the method for applying driving signals to corresponding pixels, the first pixel element 220 of this embodiment may include eight pixels adjacent to each other and arranged in a column, and the pixels are arranged in the following order: a first pixel 240, a second pixel 250, a third pixel 260 and a fourth pixel 270, which are arranged vertically in sequence and repeated according to the order. The second pixel element 230 includes eight pixels adjacent to each other and arranged in a column, and the pixels are arranged in the following order: a third pixel 260, a fourth pixel 270, a first pixel 240 and a second pixel 250, which are arranged vertically in sequence and repeated according to the order.

This solution provides another pixel architecture having eight pixels. The eight pixels in the first pixel element 220 are arranged in a column, including two first pixels 240, two second pixels 250, two third pixels 260 and two fourth pixels 270. Two identical pixels are spaced by three other pixels, and the three other pixels are of different colors, to achieve even display of colors in a pixel. In the first pixel element 220 and the second pixel element 230, only the order in which the pixels are arranged is changed, so that any two neighboring pixels selected from the first pixel element 220 and two neighboring pixels in the second pixel element 230 can constitute four different pixels. Such a configuration achieves a more even pixel arrangement of the entire display panel 200 is more even, making the display of the display panel 200 more even.

Based on the above pixel arrangement, arrangement of driving signals applied to corresponding pixels may be obtained.

In step S1, in the first pixel element 220, in the polarities of the driving signals applied to the first four pixels: the polarities of the driving signals applied to the first pixel 240 and the fourth pixel 270 are the same, the polarities of the driving signals applied to the second pixel 250 and the third pixel 260 are the same, and the polarities of the driving signals applied to the first pixel 240 and the fourth pixel 270 are opposite to the polarities of the driving signals applied to the second pixel 250 and the third pixel 260; and the polarities of the driving signals applied to the last four pixels are opposite to the polarities of the same pixels among the first four pixels. In a specific implementation, the polarity of the driving signal applied to the first pixel 240 is positive, the polarity of the driving signal applied to the second pixel 250 is negative, the polarity of the driving signal applied to the third pixel 260 is negative and the polarity of the driving signal applied to the fourth pixel 270 is positive. The polarities of the driving signals applied to the last four pixels is as follows: the polarity of the driving signal applied to the first pixel 240 is negative, the polarity of the driving signal applied to the second pixel 250 is positive, the polarity of the driving signal applied to the third pixel 260 is positive and the polarity of the driving signal applied to the fourth pixel 270 is negative. A symbol representation is +−+−++−.

In the second pixel element 230, in the polarities of the driving signals applied to the first four pixels: the polarities of the driving signals applied to the third pixel 260 and the second pixel 250 are the same, the polarities of the driving signals applied to the fourth pixel 270 and the first pixel 240 are the same, and the polarities of the driving signals applied to the third pixel 260 and the second pixel 250 are opposite to the polarities of the driving signals applied to the fourth pixel 270 and the first pixel 240; and the polarities of the driving signals applied to the last four pixels are opposite to the polarities of the same pixels among the first four pixels. In a specific implementation, the polarity of the driving signal applied to the third pixel 260 is negative, the polarity of the driving signal applied to the fourth pixel 270 is positive, the polarity of the driving signal applied to the first pixel 240 is positive and the polarity of the driving signal applied to the second pixel 250 is negative. The polarities of the driving signals applied to the last four pixels is as follows; the polarity of the driving signal applied to the third pixel 260 is positive, the polarity of the driving signal applied to the fourth pixel 270 is negative, the polarity of the driving signal applied to the first pixel 240 is negative and the polarity of the driving signal applied to the second pixel 250 is positive. A symbol representation is −++−+−−+. In a next polar period, polarities of driving signals at corresponding positions of the original pixels are reversed. In other words, in the first pixel element 220, the polarities of the driving signals applied to the first four pixels are as follows: the polarity of the driving signal applied to the first pixel 240 is negative, the polarity of the driving signal applied to the second pixel 250 is positive, the polarity of the driving signal applied to the third pixel 260 is positive and the polarity of the driving signal applied to the fourth pixel 270 is negative. In the second pixel element 230, the polarities of the driving, signals applied to the last four pixels are as follows: the polarity of the driving signal applied to the third pixel 260 is positive, the polarity of the driving signal applied to the fourth pixel 270 is negative, the polarity of the driving signal applied to the first pixel 240 is negative and the polarity of the driving signal applied to the second pixel 250 is positive. In the second pixel element 230, the polarities of the driving signals applied to the first four pixels are as follows: the polarity of the driving signal applied to the third pixel 260 is positive, the polarity of the driving signal applied to the fourth pixel 270 is negative, the polarity of the driving signal applied to the first pixel 240 is negative and the polarity of the driving signal applied to the second pixel 250 is positive. The polarities of the driving signals applied to the last four pixels are as follows: the polarity of the driving signal applied to the third pixel 260 is negative, the polarity of the driving signal applied to the fourth pixel 270 is positive, the polarity of the driving signal applied to the first pixel 240 is positive and the polarity of the driving signal applied to the second pixel 250 is negative.

This solution is a polarity driving method for the above pixel architecture. The polarities of the driving signals applied to the eight pixels in the first pixel element 220, namely, the first pixel 240, the second pixel 250, the third pixel 260, the fourth pixel 270, the first pixel 240, the second pixel 250, the third pixel 260 and the fourth pixel 270, are respectively represented as +−−+−++−. In this case, the polarities of the two first pixels 240 in the first pixel element 220 are different. Similarly, the polarities of the driving signals applied to the two second pixels 250 are different, the polarities of the driving signals applied to the two third pixels 260 are different, and the polarities of the driving signals applied to the two fourth pixels 270 are different. In both the second pixel element 230 and the first pixel element 220, driving signals of opposite polarities are applied to same pixels. In a next polar period, polarities of pixels at the same positions are opposite to those in the previous period. In this case, in the first pixel element 220 and the second pixel element 230, the quantity of pixels of negative polarity is equal to the quantity of pixels of positive polarity. Therefore, the quantity of pixels of negative polarity is also equal to the quantity of pixels of positive polarity in a picture of the entire display panel 200, so as to effectively avoid screen flickering.

In the above pixels, the first pixel 240 is red, the second pixel 250 is green, the third pixel 260 is blue and the fourth pixel 270 is white. This solution is a specific RGBW pixel architecture design, in which the first pixel 240 is set to red, the second pixel 250 is set to green, the third pixel 260 is set to blue and the fourth pixel 270 is set to white, so that polarities of pixels of the same color are opposite, thereby achieving a good display effect of the display panel 200. Certainly, in this solution, the colors may also be arranged in different orders, and this application is not limited to the color arrangement provided in this solution.

Figure 7:
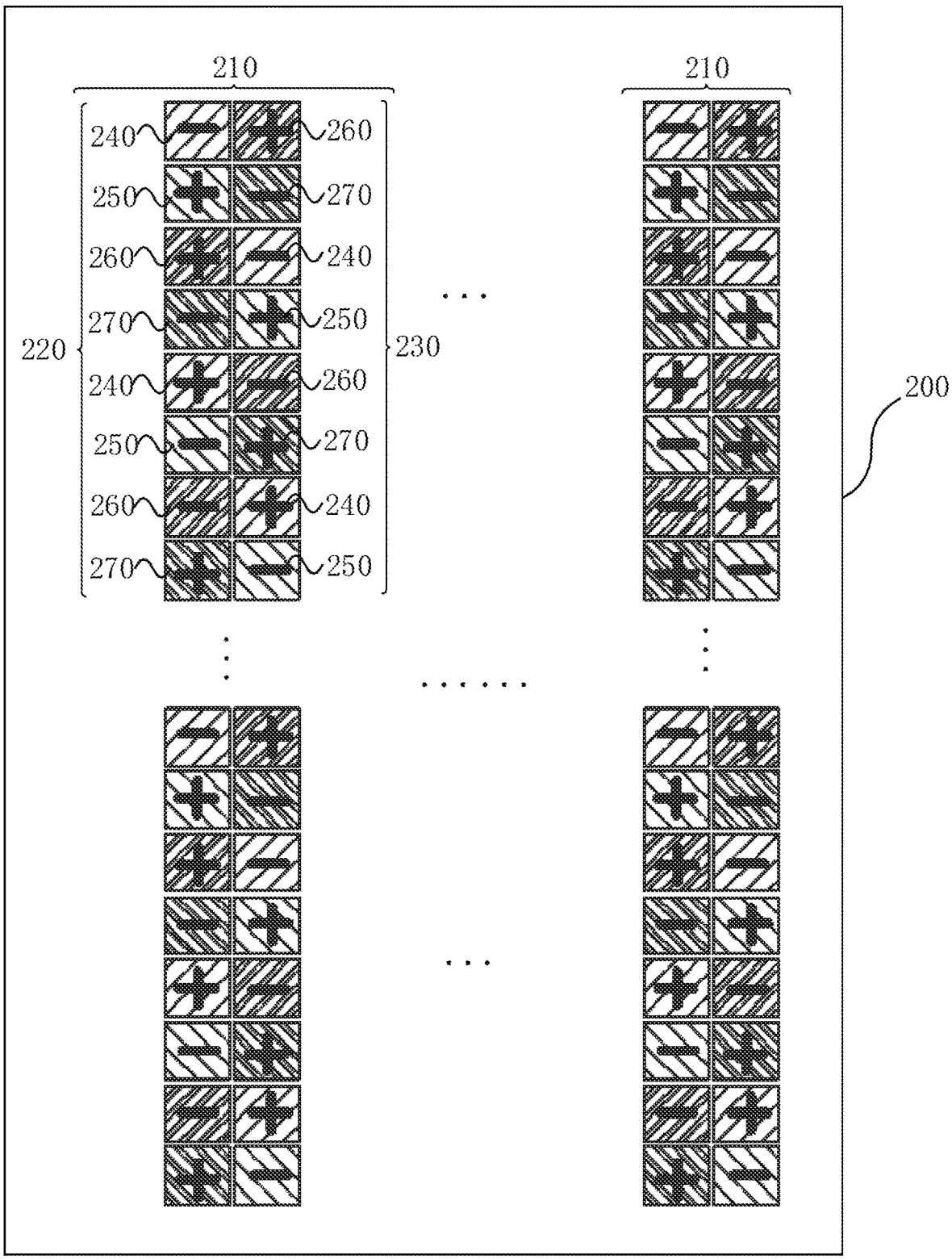
FIG. 7 is a schematic diagram of a polarity driving method in odd-numbered frames for a display panel according to an embodiment of this application, with horizontal arrangement of pixels and vertical arrangement of driving signals.
Figure 8:
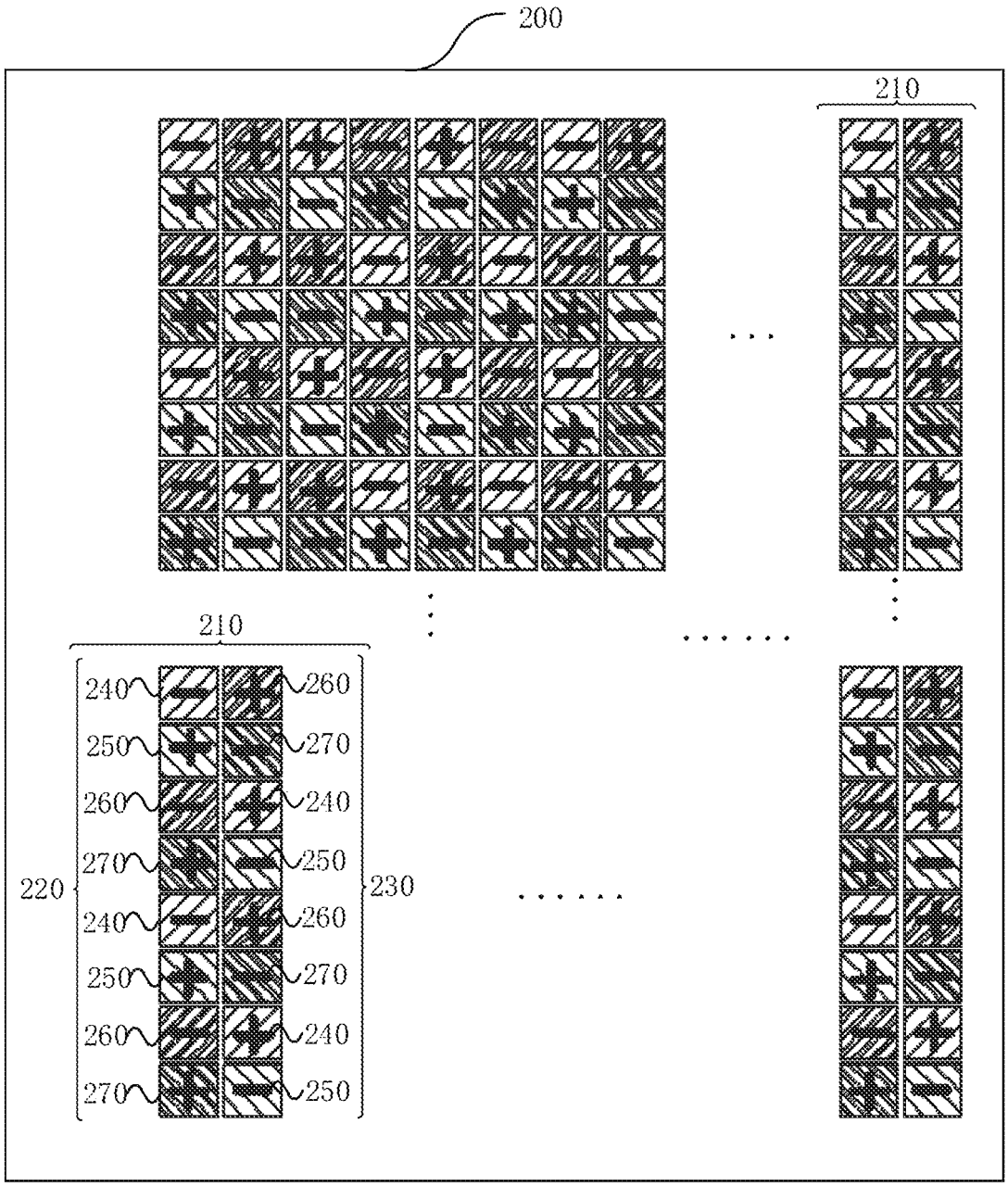
FIG. 8 is a schematic diagram of another polarity driving method in even-numbered frames for a display panel according to an embodiment of this application, with horizontal arrangement of pixels and vertical arrangement of driving signals.

FIG. 7 and FIG. 8 are each a schematic diagram of another driving method for a display panel. In this application, eight pixels may be vertically arranged, and driving signals for the pixels horizontally arranged are still used, so as to ensure that polarities of driving signals of pixels of the same color in a pixel are evenly distributed. A horizontal arrangement of eight pixels and a vertical arrangement of driving signals may also be used, as long as such arrangements are applicable to this solution.

For driving of the display panel, one polar period corresponds to a display time of one frame of driving data. Because one polar period corresponds to a display time of one frame of driving data, the polarity is reversed to drive in a next frame of display, so that the polarity reversal can be controlled by using a signal of driving data in each frame, thereby simplifying, a polarity reversal control circuit, and effectively preventing screen flickering during displaying in one polar period. In this solution, one polar period may also correspond to a display time of two frames, of driving data.

Figure 9:
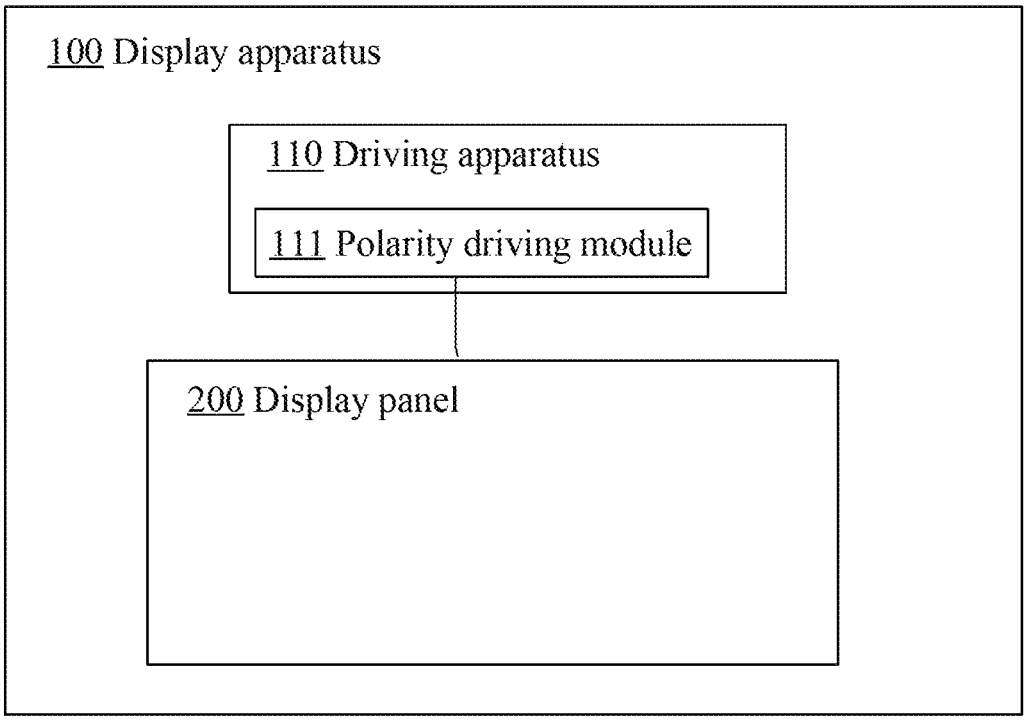
FIG. 9 is a schematic diagram of a display apparatus according to an embodiment of this application.

FIG. 9 is a schematic diagram of a display apparatus. In one or more embodiments of this application, a display apparatus 100 using the foregoing driving method is disclosed. The display apparatus 100 includes a display panel 200 and a driving apparatus 110. The display panel 200 includes a plurality of pixel groups. Each of pixel groups includes a first pixel element and a second pixel element that are arranged in columns. The first pixel element and the second pixel element respectively include the same quantity of pixels of different colors. The driving apparatus 110 is configured to output a driving signal to drive the display panel 200. A polarity of a driving signal output by the driving apparatus 110 to a pixel of a color in the first pixel element of the display panel is opposite to a polarity of a driving signal output by the driving apparatus to a pixel of the color in the second pixel element. Because the display panel 200 includes a plurality of pixel groups, each of pixel groups includes a first pixel element and a second pixel element that are arranged in columns, the first pixel element and the second pixel element respectively include the same quantity of pixels of different colors, uneven display of colors in a same pixel group can be avoided. In addition, because polarities of driving signals applied to pixels of the same color in the first pixel element and in the second pixel element are opposite, such an arrangement can avoid screen flickering during displaying.

It should be noted that the sequence numbers of steps involved in a specific solution should not be considered as limiting the order of steps as long as the implementation of this solution is not affected. The steps appearing earlier may be executed earlier than, later than, or at the same time as those appearing later. Such implementations shall all be considered as falling within the protection scope of this application as long as this solution can be implemented.

The display panel of this application may be a Twisted Nematic (TN) panel, an In-Plane Switching (IPS) panel, a Multi-Domain Vertical Alignment (MVA) panel, or a Vertical Alignment (VA) panel, and may certainly be any other suitable type of panel.

The foregoing contents are detailed descriptions of this application in conjunction with specific optional embodiments, and it should not be considered that the specific implementation of this application is limited to these descriptions. Persons of ordinary skill in the art can further make simple deductions or replacements without departing from the concept of this application, and such deductions or replacements should all be considered as falling within the protection scope of this application.

What is claimed is:

1. A driving method for a display panel, wherein the display panel is divided into a plurality of pixel groups that repeats vertically, wherein each of the plurality of pixel groups comprises a first pixel element and a second pixel element that are arranged in a first direction; wherein the first pixel element and the second pixel element each consist of a same quantity of pixels of different colors arranged along a second direction, wherein the first direction is perpendicular to the second direction, wherein in a same frame, driving signals corresponding to every two pixels of a same color in the first pixel element have opposite polarities, and driving signals corresponding to every two pixels of a same color in the second pixel element have opposite polarities; wherein the driving method comprises the following steps:

outputting, during a polar period, a driving signal to a corresponding pixel; and outputting, during a next polar period, a driving signal of a reversed polarity to a corresponding pixel, wherein in the step of outputting, during the polar period, the driving signal to the corresponding pixel, driving signals corresponding to every two pixels of a same color in the first pixel element have opposite polarities, and driving signals corresponding to every two pixels of a same color in the second pixel element have opposite polarities;

wherein the first pixel element comprises eight pixels adjacent to each other and arranged in a row, and the pixels are arranged in the following order: a first pixel, a second pixel, a third pixel, and a fourth pixel, which are arranged horizontally in sequence and repeated according to the order; the second pixel element comprises eight pixels adjacent to each other and arranged in a row, and the pixels are arranged in the following order: a third pixel, a fourth pixel, a first pixel, and a second pixel, which are arranged horizontally in sequence and repeated according to the order; wherein the first direction is a column direction and the second direction is a row direction; wherein in the step of outputting, during the polar period, the driving signal to the corresponding pixel to drive the display panel:

in the first pixel element, polarities of driving signals applies to the first four pixels are arranged as follows: the polarities of the driving signals applied to the first pixel and the fourth pixel are the same, the polarities of the driving signals applied to the second pixel and the third pixel are the same, and the polarities of the driving signals applied to the first pixel and the fourth pixel are opposite to the polarities of the driving signals applied to the second pixel and the third pixel; and polarities of driving signals applied to the last four pixels in the first pixel element are respectively opposite to the polarities of the driving signals applied to the same pixels among the first four pixels;

in the second pixel element, polarities of driving signals applied to the first four pixels are arranged as follows: the polarities of the driving signals applied to the third pixel and the second pixel are the same, the polarities of the driving signals applied to the fourth pixel and the first pixel are the same, the polarities of the driving signals applied to the third pixel and the second pixel are opposite to the polarities of the driving signals applied to the fourth pixel and the first pixel; and polarities of driving signals applied to the last four pixels in the second pixel element are respectively opposite to the polarities of the driving signals applied to the same pixels among the first four pixels; and wherein the polarities of the driving signals applied to the eight pixels in the first pixel element are opposite to the polarities of the driving signals applied to the vertically corresponding eight pixels in the second pixel element.

2. The driving method for the display panel according to claim 1, wherein in the first pixel element, the driving signals applied to the first four pixels are as follows: the polarity of the driving signal applied to the first pixel is positive, the polarity of the driving signal applied to the second pixel is negative, the polarity of the driving signal applied to the third pixel is negative and the polarity of the driving signal applied to the fourth pixel is positive; the polarities of the driving signals applied to the last four pixels in the first pixel element are respectively opposite to the polarities of the driving signals applied to the same pixels among the first four pixels;

in the second pixel element, the driving signals applied to the first four pixels are as follows: the polarity of the driving signal applied to the third pixel is negative, the polarity of the driving signal applied to the fourth pixel is positive, the polarity of the driving signal applied to the first pixel is positive and the polarity of the driving signal applied to the second pixel is negative; and the polarities of the driving signals applied to the last four pixels in the second pixel element are respectively opposite to the polarities of the driving signals applied to the same pixels among the first four pixels.

3. The driving method for the display panel according to claim 1, wherein in the first pixel element, the driving signals applied to the first four pixels are as follows: the polarity of the driving signal applied to the first pixel is negative, the polarity of the driving signal applied to the second pixel is positive, the polarity of the driving signal applied to the third pixel is positive and the polarity of the driving signal applied to the fourth pixel is negative; the polarities of the driving signals applied to the last four pixels in the first pixel element are respectively opposite to the polarities of the driving signals applied to the same pixels among the first four pixels;

in the second pixel element, the driving signals applied to the first four pixels are as follows: the polarity of the driving signal applied to the third pixel is positive, the polarity of the driving signal applied to the fourth pixel is negative, the polarity of the driving signal applied to the first pixel is negative and the polarity of the driving signal applied to the second pixel is positive; and the polarities of the driving signals applied to the last four pixels in the second pixel element are respectively opposite to the polarities of the driving signals applied to the same pixels among the first four pixels.

4. The driving method for the display panel according to claim 1, wherein the polar period is a display time of one frame.

5. The driving method for the display panel according to claim 1, wherein the polar period is a display time of two frames.

6. A display apparatus driven by a driving method for a display panel, comprising:

the display panel, wherein the display panel is divided into a plurality of pixel groups that repeats vertically, wherein each of the plurality of pixel groups comprises a first pixel element and a second pixel element that are arranged in columns, and the first pixel element and the second pixel element each consist of a same quantity of pixels of different colors; and a driving apparatus, configured to output a driving signal to drive the display panel, wherein in a same frame, driving signals corresponding to every two pixels of a same color in the first pixel element have opposite polarities, and driving signals corresponding to every two pixels of a same color in the second pixel element have opposite polarities;

wherein the first pixel element comprises eight pixels adjacent to each other and arranged in a row, and the pixels are arranged in the following order: a first pixel, a second pixel, a third pixel, and a fourth pixel, which are arranged horizontally in sequence and repeated according to the order; the second pixel element comprises eight pixels adjacent to each other and arranged in a row, and the pixels are arranged in the following order: a third pixel, a fourth pixel, a first pixel, and a second pixel, which are arranged horizontally in sequence and repeated according to the order; wherein the first direction is a column direction and the second direction is a row direction; wherein in the step of outputting, during the polar period, the driving signal to the corresponding pixel to drive the display panel:

in the first pixel element, polarities of driving signals applies to the first four pixels are arranged as follows: the polarities of the driving signals applied to the first pixel and the fourth pixel are the same, the polarities of the driving signals applied to the second pixel and the third pixel are the same, and the polarities of the driving signals applied to the first pixel and the fourth pixel are opposite to the polarities of the driving signals applied to the second pixel and the third pixel; and polarities of driving signals applied to the last four pixels in the first pixel element are respectively opposite to the polarities of the driving signals applied to the same pixels among the first four pixels;

in the second pixel element, polarities of driving signals applied to the first four pixels are arranged as follows: the polarities of the driving signals applied to the third pixel and the second pixel are the same, the polarities of the driving signals applied to the fourth pixel and the first pixel are the same, the polarities of the driving signals applied to the third pixel and the second pixel are opposite to the polarities of the driving signals applied to the fourth pixel and the first pixel; and polarities of driving signals applied to the last four pixels in the second pixel element are respectively opposite to the polarities of the driving signals applied to the same pixels among the first four pixels; and wherein the polarities of the driving signals applied to the eight pixels in the first pixel element are opposite to the polarities of the driving signals applied to the vertically corresponding eight pixels in the second pixel element.

7. The display apparatus according to claim 6, wherein the display panel is a Vertical Alignment panel.

* * * * *